US005439374A

United States Patent [19]

Jamieson

[11] Patent Number: 5,439,374

[45] Date of Patent: Aug. 8, 1995

[54] MULTI-LEVEL FLAME CURENT SENSING CIRCUIT

[75] Inventor: J. Scott Jamieson, Waukesha, Wis.

[73] Assignee: Johnson Service Company, Milwaukee, Wis.

[21] Appl. No.: 92,754

[22] Filed: Jul. 16, 1993

[51] Int. Cl.[6] ..... F23Q 23/00

[52] U.S. Cl. ..... 431/25; 431/18; 431/74; 431/80; 431/26; 431/24

[58] Field of Search ..... 431/25, 26, 24, 18, 431/74, 80

[56] References Cited

U.S. PATENT DOCUMENTS 3,423,158 1/1969 Forbes .
3,627,458 12/1971 Wade .
4,672,324 6/1987 van Kampen .
4,710,125 12/1987 Nakamura et al. .
4,871,307 10/1989 Harris et al. .
4,955,806 9/1990 Grunden et al. .
5,055,825 10/1991 Yang ..... 431/24 X
5,256,057 10/1993 Grow ..... 431/25 X

FOREIGN PATENT DOCUMENTS 2115616 4/1990 Japan ..... 431/25
2065345 6/1981 United Kingdom ..... 431/25
2089975 6/1982 United Kingdom ..... 431/25

*Primary Examiner*—Larry Jones
*Attorney, Agent, or Firm*—Foley & Lardner

[57] ABSTRACT

A circuit for producing signals representative of at least two flame current levels is disclosed herein. The circuit includes two electrodes locatable in a flame, where a voltage potential is set up between the electrodes, and the current flow is measured therebetween (flame current). The circuit includes an amplifying portion for amplifying the flame current and applying a signal to a microprocessor. The microprocessor samples the signal and outputs a signal representative of the flame current level.

20 Claims, 2 Drawing Sheets

MULTI-LEVEL FLAME CURENT SENSING CIRCUIT

FIELD OF THE INVENTION

The present invention generally relates to devices designed to determine whether or not a flame, such as the flame of a pilot light, is present in a flame area. More specifically, the present invention relates to sensing the current conducted through a flame area to determine whether or not the current conducted is indicative of the presence of a flame.

BACKGROUND OF THE INVENTION

Many appliances, such as furnaces, use pilot lights for igniting the main burner of the appliance. For example, in a high efficiency furnace, a pilot light or igniting flame is ignited by a spark or electrically heated ignitor in response to a request for heat signal from a thermostat. This igniting flame provides the energy to ignite the fuel (e.g., natural gas) and air mixture at the combustion chamber of the furnace. However, it is important that the igniting flame is present before the fuel valve of the furnace is opened to provide fuel to the combustion chamber. Thus, the control system for the fuel valve must include a system for ensuring that an igniting flame is present when required to ignite the fuel-air mixture at the combustion chamber.

One way to sense the presence of a flame is to provide a voltage potential between two electrodes (e.g., flame hood and electrode near the tip of the flame), both located within a flame area (the area occupied by the ionized gases of a flame when a flame is present). The current flow within the flame area between the electrodes is monitored and will exceed a certain threshold when a flame is present due to the conductivity of the ionized gases in the flame area, By way of example, a typical furnace would apply 24 volts to the electrodes and a current of 50 or more nanoamps would indicate that a flame is present.

Electronics for accurately sensing currents in the range of 50 nanoamps can be relatively sensitive, since noise can substantially influence such sensing. Furthermore, circuits for flame current sensing in furnaces must be fail-safe for safety reasons. Accordingly, to provide reasonably priced fail-safe circuits for sensing flame current, circuits have been produced which only give a binary signal (flame present) based upon the presence or absence of a threshold flame current.

Flame current sensing circuits which only indicate that a flame is present or absent fulfill the primary need of flame detection; however, these circuits do not provide any information about the value of the flame current other than that it is above or below a setpoint.

For purposes of maintaining the electrodes of a flame current sensing circuit, and troubleshooting, it would be useful to have more information about the value of the flame current. For example, a typical problem with flame current sensing circuits is that the electrodes form a resistive layer over time due to oxidation and carbon deposits. When the resistance caused by such deposits becomes too great, the flame current is reduced and the circuit determines that a flame is not present, regardless of the presence of a flame, and prevents the furnace from operating. One solution to this problem is to clean the electrodes. However, this may only solve the problem temporarily if one or both of the electrodes were not sufficiently cleaned. Thus, it would be desirable to know how much the flame current exceeds the setpoint for purposes of checking electrode performance and predicting electrode cleaning schedules.

Accordingly, it would be useful to provide a simple, low-cost flame sensing circuit which could produce output signals representative of more than one flame current level and, preferably, output signals representative of a range of flame current levels.

SUMMARY OF THE INVENTION

The present invention provides for a flame detection circuit for detecting the presence of a flame between first and second electrodes. The impedance of the current path between the electrodes depends upon the presence of a flame between the electrodes, and with a given current supply, the current flow between the electrodes increases in the presence of a flame. The circuit includes a current sensing circuit coupled to the first and second electrodes. The current sensing circuit is configured to generate a first signal representative of a flame current above a first current level and a second signal representative of the flame current above a second current level greater than the first current level.

The present invention further provides a flame detection system. The system comprises an alternating current power source coupled to first and second electrodes and a signal generating circuit also coupled between the electrodes. The electrodes are disposed to rest within the flame of a furnace ignition device such as a pilot light. The signal generating circuit is configured to generate a first signal when the flame current exceeds a first predetermined amperage and a second signal when the flame current exceeds a second predetermined amperage, the first predetermined amperage being lower than the second predetermined amperage.

The present invention still further provides a flame detection system including a current amplifying circuit and a processor. The current amplifying circuit is coupled to an electrode disposed in the location of a pilot light flame, and generates an amplified current proportional to the flame current. The system also includes a capacitor coupled to the amplifying circuit and the processor. The capacitor is charged by the amplified current, where the rate of charge of the capacitor is proportional to the flame current and the voltage across the conductor increases at a rate proportional to the flame current. The processor is configured to discharge the capacitor when the voltage across the capacitor reaches a predetermined voltage, and measure a time required for the voltage across the capacitor to reach the predetermined voltage.

DETAILED DESCRIPTION OF THE PREFERRED EMBODIMENTS

Figure 1:
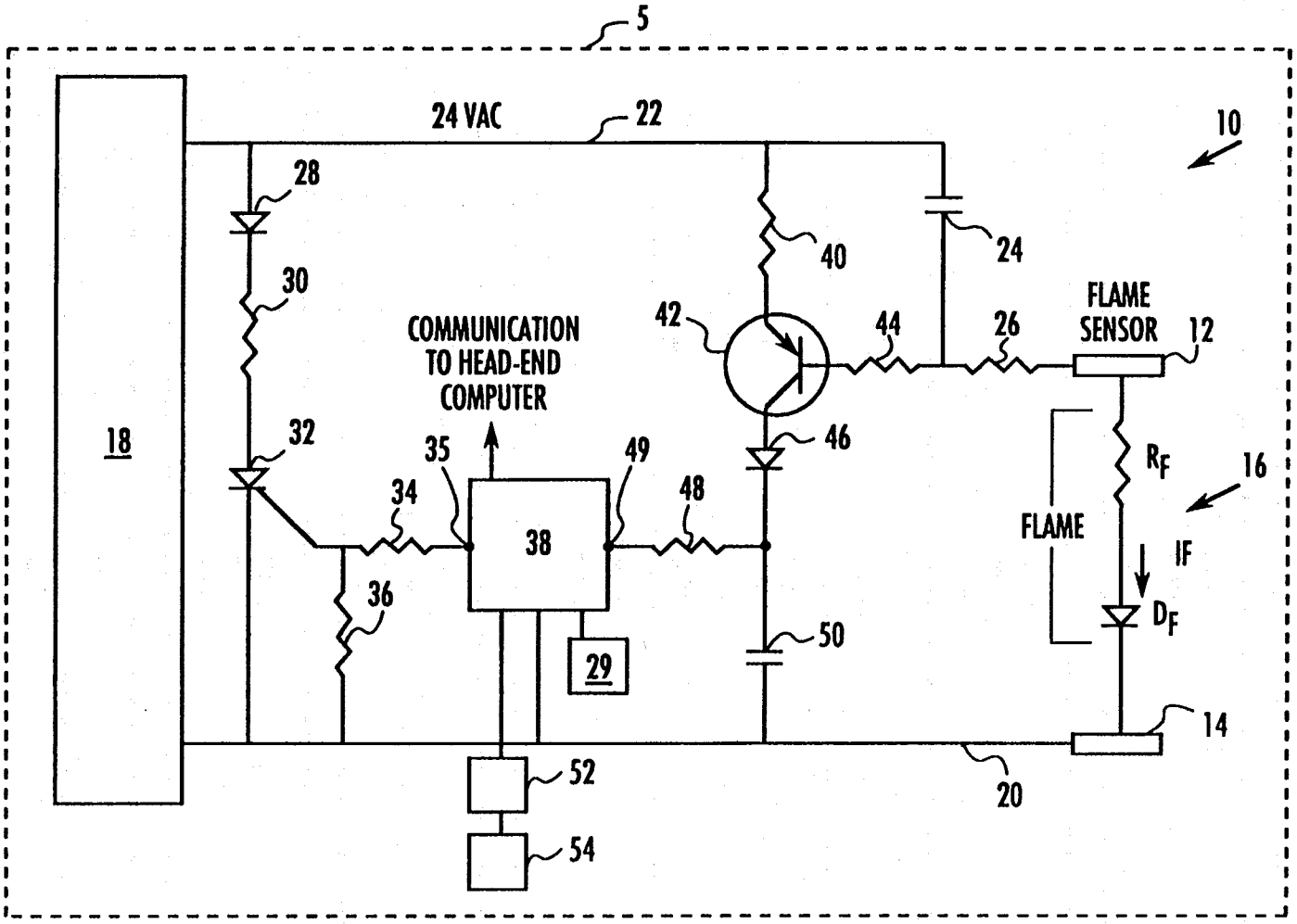
FIG. 1 is a circuit diagram for a first embodiment of a flame current sensing circuit usable within a furnace.

Referring to FIG. 1, a furnace 5 includes a flame current sensing circuit 10 which is coupled to a flame sensor (first electrode) 12 and a burner housing (second electrode) 14. Flame 16 emanates from housing 14. Electrode 12 is positioned so that when a flame 16 is present, electrode 12 is located within flame 16. Thus, flame 16 is in electrical contact with first and second electrodes 12 and 14, and the ionized gases of flame 16 reduce the resistance of the current path between electrodes 12 and 14 below the resistance of the path in the absence of a flame. In general, flame 16 is modeled as a resistance Rf and a diode Df. More specifically, flame 16 acts in part as a rectifying circuit, where the ratios of flame current in opposite directions along the current path in flame 16 are generally in the range of 1 to 5 depending upon the positioning of electrodes 12 and 14.

The present embodiment of circuit 10 is powered by the 24 VAC supply 18 of the type typically found in residential furnaces. Supply 18 includes a neutral lead 20 and a power lead 22. Lead 20 is coupled to electrode 14 and lead 22 is connected to electrode 12 by the series connection of a capacitor 24 and a resistor 26. The voltage of supply 18 was chosen since it is the voltage typically available at residential furnaces for use in furnace controls. However, depending upon the application the voltage of supply 18 may vary, and appropriate changes would be made in circuit 10 to accommodate such changes. For example, an advantage of increasing the voltage of supply 18 is that higher flame currents can be achieved, it typically being easier to monitor higher flame currents.

In addition to capacitor 24 and resistor 26, circuit 10 includes an LED 28, a resistor 30, an SCR 32, a resistor 34, a resistor 36, a microprocessor 38, a resistor 40, a transistor 42, a resistor 44, a diode 46, a resistor 48 and a capacitor 50. LED 28, resistor 30 and SCR 32 are connected in series between lead 22 and lead 20, where the anode of LED 28 is connected to lead 22 and the cathode of SCR 32 is connected to lead 20. The gate of SCR 32 is coupled to an I/O port 35 of processor 38 by resistor 34, and to lead 20 by resistor 36.

Resistor 40, transistor 42, diode 46 and capacitor 50 are connected in series between lead 22 and lead 20. In particular, the emitter of transistor 42 is connected to lead 22 by resistor 40, the collector is connected to the anode of diode 46 and the base is connected to the junction between capacitor 24 and resistor 26 by resistor 44. The cathode of diode 46 is connected to an I/O port 49 of processor 38 by resistor 48 and connected to lead 20 by capacitor 50. Processor 38 is grounded at lead 20.

By way of example only, processor 38 may be a Motorola XC68HC805C4CP, and the above-described components may have the following values:

| | |
|---|---|
| capacitor 24 | .047 microfarads |
| resistor 26 | 4.7 MOhms |
| resistor 30 | 1.7 KOhms |
| resistor 34 | 4.7 KOhms |
| resistor 36 | 4.7 KOhms |
| resistor 40 | 470 KOhms |
| resistor 44 | 6.8 MOhms |
| transistor 42 | PNP transistor with a gain greater than 100 at 1 microamp. |
| resistor 48 | 2.2 KOhms |
| capacitor 50 | .047 microfarads |

In general, circuit 10 operates to produce a voltage at capacitor 50 which increases with time at a rate generally proportional to the magnitude of the current passing from electrode 12 to electrode 14 (flame current). Processor 38 samples the status of port 49 once every cycle of the power source. For a 60 Hz power source, this would be once every 0.0167 seconds. If the status of port 49 goes from low to high (above 2 volts) within a predetermined number (N) of cycles (e.g. 8 cycles), processor 38 is programmed to determine that a flame is present between electrodes 12 and 14. In response, processor 38 will produce appropriate output signals applied to an associated fuel valve 52 which is coupled to a main burner 54 of furnace 5. This output signal causes valve 52 to open and the fuel at main burner 54 to be ignited by flame 16. After each N cycles, processor 38 controls port 49 to discharge capacitor 50.

In addition to the functions discussed above for processor 38, processor 38 is typically configured to control other functions of furnace 5, such as blower control.

One of the problems which is encountered with present electrodes 12 and 14 is an increase in surface resistance of the electrodes due to processes such as oxidation and carbon build up. When electrodes 12 and 14 develop a surface resistance which exceeds a particular threshold, circuit 10 will never sense a flame current regardless of whether a flame is present or not. Specifically, the surface resistance will be too high to allow sufficient current to flow through the flame to charge capacitor 50 within N cycles. As a result, the furnace associated with circuit 10 will not operate since processor 38 will not permit ignition of the main burner. A solution to this problem has been to clean electrodes 12 and 14. However, service personnel cannot typically determine how well the electrodes are cleaned. Accordingly, if electrodes 12 and 14 are marginally clean, the circuit 10 will sense a flame current and allow the furnace to operate for a short period of time until the surface resistance again increases beyond the threshold for sensing a flame current.

Circuit 10 is configured to determine more than just whether the flame current exceeds an acceptable minimum threshold which indicates with adequate certainty that a flame is present between electrodes 12 and 14. Circuit 10 also determines whether the flame current is above one or more amperage levels, and can provide an indication of the amount the flame current exceeds the minimum threshold. Accordingly, upon cleaning electrodes 12 and 14, a service person can operate the circuit 10 to determine whether or not the flame current is high enough to conclude that the electrodes have been adequately cleaned.

Figure 2:
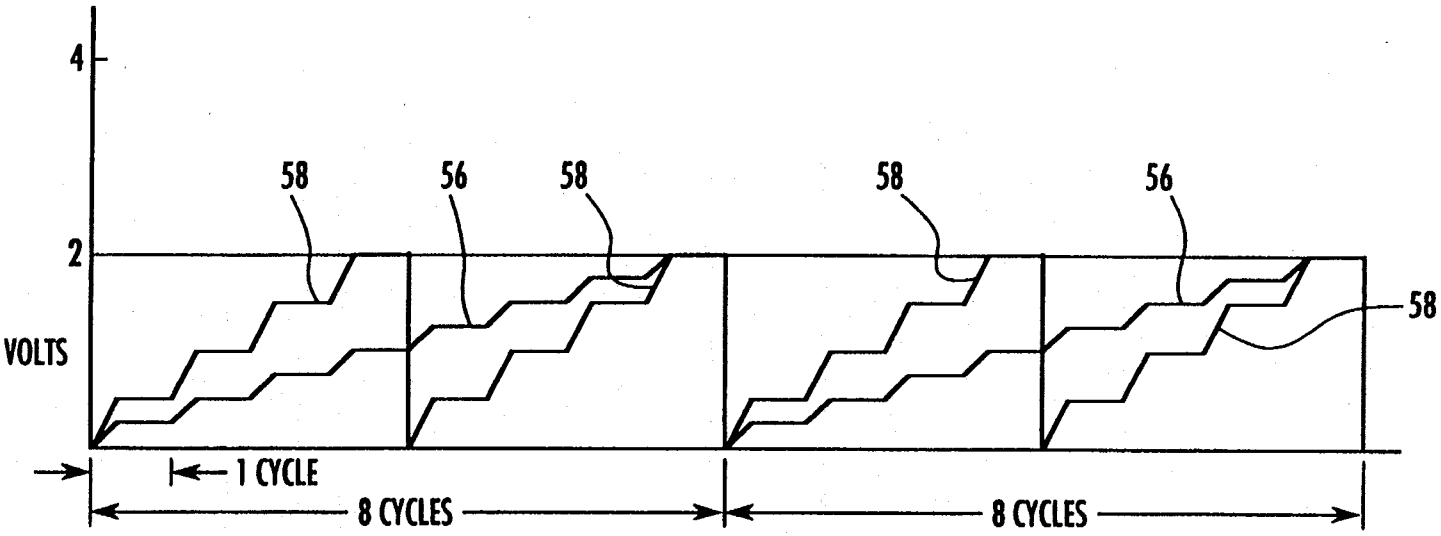
FIG. 2 is a graphical representation of a waveform plotted in the time and voltage domain.

Referring to FIG. 2, the voltage across resistor 48 and capacitor 50 is graphically illustrated in reference to 16 cycles of AC power source 18, where processor 38 is programmed to discharge capacitor 50 every 8th cycle or on the cycle in which the signal at port 49 goes high, whichever occurs first. The generally truncated step shape of the voltage is the result of the use of an AC power source 18 and the circuit configuration which only allows charging of capacitor 50 during one-half of each cycle.

Curve 56 illustrates the increase in voltage across capacitor 50 over 8 cycles. Based upon curve 56, processor 38 will determine that the minimum threshold for flame current is met and that the flame current is at its lowest permitted level, since the full 8 cycles elapsed before the potential across resistor 48 and capacitor 50 reached the threshold of 2 volts. Curve 58 illustrates that the flame current is twice that of the threshold since only 4 cycles elapsed before the potential across resistor 48 and capacitor 50 reached the threshold of 2 volts. Circuit 10 is configured so that the time rate of Change of the voltage across capacitor 50 is a generally linear function for a substantially constant flame current. Accordingly, since the voltage across capacitor 50 is proportional to the flame current and the voltage is a linear function of time, the flame current is defined by the following function:

$IF=K*8/M$ for $M$ greater than 1 and less than or equal to 8;

where IF is the flame current, M is the number of cycles which elapse before the voltage across resistor 48 and capacitor 50 exceeds 2 volts, and K is a proportionality constant which is set based upon the flame current which is present when the potential across resistor 48 and capacitor 50 reaches 2 volts in eight cycles. For example, if a flame current of 50 nanoamps indicates that a flame is present, then K is 50 nanoamps. Thus, if processor 38 senses 2 volts at pin 49 in 2 cycles, the flame current is estimated at 200 nanoamps. Accordingly, this embodiment of circuit 10 produces flame current sensing at more than two levels or thresholds. More specifically, this embodiment provides M−1 flame current levels.

Referring now to the detailed operation of circuit 10, the resistance between electrodes 12 and 14 is typically above 100 Mohms when a flame is not present. In the absence of a flame, very little charge is accumulated on capacitor 24. Thus, transistor 42 remains non-conducting, and charge does not accumulate on capacitor 50. When a flame is present between electrodes 12 and 14, the charge on capacitor 24 goes above the forward voltage of transistor 42 (e.g. 0.6 volts) and base current will begin to flow. In response to the base current flow, a collector-to-emitter current will flow when lead 22 is positive. The collector-to-emitter current will cause a voltage drop across resistor 40 that will track changes in the charge of capacitor 24. During this time, the input impedance of transistor 42 will be approximately the product of the gain of the transistor and the value of resistor 40.

When lead 22 is negative, current flow does not occur through diode 46 or transistor 42. Therefore, the voltage on resistor 40 will not track the charge on capacitor 24. As a result, the input impedance of transistor 42 will be only the value of resistor 40 when the voltage on capacitor 24 is greater than 0.5 volts. Thus, the effective load on capacitor 24 will be the sum of resistors 40 and 44. Since resistor 44 has a much greater resistance than resistor 40, the load on capacitor 24 is the resistance of resistor 44 when lead 22 is negative and almost an infinite resistance when lead 22 is positive. Accordingly, the value of resistor 44 determines the amount of charge which accumulates on capacitor 24 for a given flame current. By way of example, based upon the present configuration of circuit 10, the voltage on capacitor 24 will be approximately the flame current IF times one-half the resistance of resistor 44.

When lead 22 is positive, transistor 42 operates as a constant current (I) source which charges capacitor 50, where the current I is defined by the following function:

$I=(0.5*IF*R44-0.5)/R40,$ where R40 and R44 are the resistances of resistors 40 and 44, respectively. When lead 22 is negative no current will flow, and the charging of C2 will be a ramp, followed by a constant voltage, followed by a ramp etc., as shown in FIG. 2.

As discussed above, when the voltage at port 49 exceeds a threshold (2 volts) within 8 cycles, processor 38 decides that a flame is present between electrodes 12 and 14. Upon the detection of a threshold voltage at port 49, or upon the occurrence of 8 cycles, whichever occurs first, processor 38 discharges capacitor 50. Resistor 48 is provided to protect processor 38 from excessive currents during the discharge of capacitor 50.

Circuit 10 is designed to include a number of features which make it fail-safe. One of these features is the programming of processor 38. In particular, the programming of processor 38 is completely run every cycle, where a cycle count is stored in processor 38 RAM. In the event that the program does not run error-free every cycle, the I/O ports which control the pilot light and main burner fuel valves are biased to cause these valves to close. Additionally, processor 38 is programmed to close all fuel valves if the voltage at port 49 reaches the threshold within one cycle, since it is assumed that such a charging rate at capacitor 50 is caused by a short in transistor 42. The failure of capacitor 50, either as an open circuit or short circuit, is also fail-safe in that in either mode of failure, the threshold voltage will not be produced at port 49 in the proper time period.

Referring to LED 28, processor 38 is programmed to drive port 35 high each time the threshold voltage is detected at port 49. Thus, the higher the flame current, the faster LED 28 will flash, and if the flame current is insufficient to charge capacitor 50 high enough within 8 cycles to produce the threshold voltage at 49, LED 28 will remain off. Further, processor 38 may be programmed to maintain SCR 32 conductive and thus keep LED 28 constantly illuminated as long as the threshold voltage at port 49 is obtained in a predetermined number of cycles less than 8, which indicates that the flame current is high enough to conclude that electrodes 12 and 14 are in good condition. Accordingly, LED 28 provides an indication of more than one flame current level in that it is constantly illuminated when the flame current is above a second level, it is flashed when the flame current is above a first level which is less than the second level, and it is off when the flame current is below the first level.

By way of modification, LED 28 may be replaced with an LCD display 29 and appropriate display driver coupled to processor 38. Display 29 would produce an alphanumeric display which would display the level at which the flame current was flowing. To refine the determination of the level of flame current, the frequency of sampling at port 49 could be increased by increasing the samples per cycle or the frequency of cycles.

In addition to producing an LED or LCD output representative of the level of flame current, processor 38 may be configured to communicate with other computers, and transmit data representative of the level of flame current to the other computers. For example, the main computer may utilize the flame current level data for the purpose of issuing a service message to the system operator. This message would be issued when the flame current is minimally above the threshold, but low enough to indicate that electrodes 12 and 14 may require servicing (e.g. cleaning) at the current time, or in the near future.

As a further modification to circuit 10, circuit 10 may be programmed to delay turning on main burner fuel valve 52 for a predetermined period of time (e.g. 5 or 10 seconds). This may be a desirable feature since the flame of burner 54 will alter the flame current when present and cause circuit 10 to sense an inaccurate flame current level. By providing the delay period, the circuit 10 has a period of time to accurately sense and display the flame current level. This feature is useful with certain indirect ignition applications.

Figure 3:
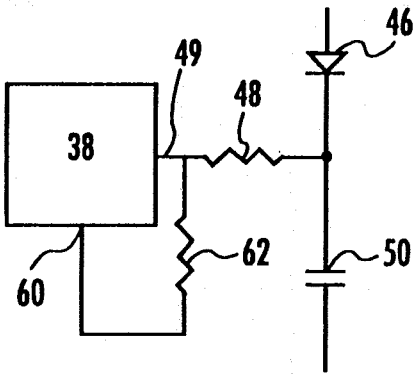
FIG. 3 is a circuit diagram for a second embodiment of a flame current sensing circuit.

A further modification of circuit 10 is shown in FIG. 3. In FIG. 3, the connection of the junction between the cathode of diode 46 and capacitor 50 is coupled to both port 49 and a second I/O port 60. Specifically, I/O port 60 is connected to port 49 by a resistor 62. In this embodiment, processor 38 is programmed to read port 49 at a given time period and determine whether or not a predetermined threshold voltage is exceeded. Processor 38 is also programmed to selectively ground port 60 during selected sampling of port 49. More specifically, when port 49 is above the predetermined threshold, port 60 is grounded to determine if port 49 remains above the predetermined threshold when the divider formed by resistors 48 and 62 is operative due to the grounding of port 60. Where the threshold is exceeded at port 49 when port 60 is not grounded, the flame current is considered to be minimally acceptable, but prompt servicing of electrodes 12 and 14 is advisable. If port 60 is grounded and port 49 is above the threshold, the flame current is considered to be sufficiently high to indicate that electrodes 12 and 14 are in good condition.

It will be understood that the above description is of the preferred exemplary embodiments of the invention, and that the invention is not limited to the specific forms shown. Various other substitutions, modifications, changes and omissions may be made in the design and arrangement of the elements of the preferred embodiment without departing from the spirit of the invention as expressed in the appended claims.

What is claimed is:

1. A flame detection circuit for detecting the presence of a flame between a first electrode and a second electrode, where the impedance of the current path between the electrodes depends upon the presence of a flame between the electrodes, the flame detection circuit comprising:

a current sensing circuit coupled to the first and second electrodes and configured to generate a first signal representative of a flame current above a first current level and a second signal representative of the flame current above a second current level greater than the first current level.

2. The flame detection circuit of claim 1, where the first and second electrodes are disposed to be electrically coupled by the flame.

3. The flame detection circuit of claim 1, further comprising an optoelectric indicator coupled to the current sensing circuit, the current sensing circuit illuminating the indicator in a first manner when the flame current is above the first current level and in a second manner when the flame current is above the second current level.

4. The flame detection circuit of claim 1, further comprising an alphanumeric display coupled to the current sensing circuit to produce a first set of display characters when the flame current is above the first current level and a second set of display characters when the flame current is above the second current level.

5. A flame detection system comprising:

a first electrode disposed on one side of a flame area;

a second electrode disposed on the other side of the flame area, where the presence of a flame between the first and second electrodes reduces the resistance therebetween;

an alternating current power source coupled to the first and second electrodes, whereby a flame current flows between the first and second electrodes when a flame is present between the first and second electrodes; and a signal generating circuit coupled to the first and second electrodes and configured to generate a first signal where the flame current exceeds a first predetermined amperage and a second signal when the flame current exceeds a second predetermined amperage, the first predetermined amperage being lower than the second predetermined amperage.

6. The flame detection system of claim 5 further comprising a visual indicator circuit coupled to the signal generating circuit, the visual indicator circuit generating a first visual indication when the flame current is less than the first predetermined amperage, a second visual indication when the flame current is greater than the first predetermined amperage and less than the second predetermined amperage, and a third visual indication when the flame current is greater than the second predetermined amperage.

7. The flame detection system of claim 5, where the generating circuit comprises:

a capacitor, coupled to the power source, the capacitor being charged to a voltage over a time period, the rate at which the capacitor is charged being representative of the flame current; and a processor coupled to the capacitor to sample the voltage at the capacitor at fixed intervals, the processor producing the second signal when the voltage exceeds a predetermined level within a first number of intervals, and the processor producing the first signal when the voltage exceeds the predetermined level within a second number of intervals greater than the first number of periods.

8. The flame detection system of claim 5, where the generating circuit comprises:

a capacitor coupled to the power source, the capacitor being charged to a voltage, over a predetermined time period, which is representative of the flame current;

a processor including a first port and a second port;

a first impedance element coupled between the capacitor and the first port;

a second impedance element coupled between the first and the second ports; and wherein the processor is configured to produce the first signal when the potential at the first port exceeds a first predetermined voltage with the second port ungrounded and the processor is configured to produce the second signal when the potential at the first port exceeds the first predetermined voltage with the second port grounded.

9. The system of claim 8, wherein the first and second signals are applied to the second port.

10. A flame detection system, comprising:

an electrode disposed opposite a flame area from a grounded contact, the electrode being connected to a power source that applies a voltage to the electrode, whereby a flame current flows between the electrode and the grounded contact when a flame is present in the flame area;

a current amplifying circuit coupled to the electrode, the current amplifying circuit generating an amplified current proportional to the flame current; and a capacitor coupled to the current amplifying circuit and arranged to be charged by the amplified current, whereby the rate of charge of the capacitor is proportional to the flame current and the voltage across the capacitor increases at a rate proportional to the flame current; and a processor coupled to the capacitor, the processor being configured to fully discharge the capacitor when the voltage across the capacitor reaches a predetermined voltage, the processor being further configured to measure a time required for the voltage across the capacitor to reach the predetermined voltage.

11. The system of claim 10, further comprising:

a switching circuit coupled to the processor; and an optoelectric indicator coupled to the switching circuit, the switching circuit and indicator being coupled to the power source, where the processor applies a first signal to the switching circuit such that the indicator is illuminated in a first manner when the time required exceeds a first limit and applies a second signal to the switching circuit such that the indicator is illuminated in a second manner when the time required exceeds a second limit greater than the first limit.

12. The system of claim 11, where the first signal causes the indicator to flash, and the second signal causes the indicator to remain illuminated.

13. The system of claim 10, where the processor is configured to discharge the capacitor after the expiration of a predetermined time period.

14. The system of claim 10, where the processor is configured to determine the level of flame current based upon the time required for the voltage across the capacitor to reach the predetermined voltage.

15. The system of claim 14, where the processor is configured to produce a first valve control signal for opening a fuel valve when the flame current exceeds a predetermined limit, and a second valve control signal for closing the fuel valve when the flame current is below the predetermined limit.

16. The system of claim 10, where the processor produces a third signal when the predetermined time period expires before the voltage across the capacitor reaches the predetermined voltage.

17. The system of claim 10, the amplifying circuit comprising a transistor coupled to the power source and the capacitor; and a second capacitor coupled between the power source and the transistor gate, and the power source and the electrode, where the potential across the second capacitor controls the current flow through the transistor.

18. The system of claim 10, the processor being configured to sample the voltage level across the capacitor at the end of time periods of predetermined length, where the processor discharges the capacitor at the end of N time periods when the voltage across the capacitor fails to reach the predetermined voltage within N time periods, the processor produces a first signal when the voltage across the capacitor reaches the predetermined voltage in M time periods, and produces a second signal when the voltage across the capacitor reaches the predetermined voltage in L time periods, M being less than N and L being less than M.

19. The system of claim 18, further comprising:

a switching circuit coupled to the processor; and an optoelectric indicator coupled to the switching circuit, the switching circuit and indicator being coupled to the power source, where the processor applies the first signal to the switching circuit to illuminate the indicator in a first manner, and applies the second signal to the switching circuit to illuminate the indicator in a second manner.

20. The system of claim 19, where the first signal causes the indicator to flash, and the second signal causes the indicator to remain illuminated.

* * * * *